US009014910B2

(12) United States Patent
Grau et al.

(10) Patent No.: US 9,014,910 B2
(45) Date of Patent: Apr. 21, 2015

(54) METHOD AND SYSTEM FOR PROVIDING VEHICLE DATA TO THIRD PARTY AUTHORIZED RECIPIENTS

(75) Inventors: Thomas P. Grau, Rochester, MI (US); Sanjay Khunger, Brighton, MI (US); Chester A. Huber, Grosse Point Farms, MI (US)

(73) Assignee: General Motors LLC, Detroit, MI (US)

( * ) Notice: Subject to any disclaimer, the term of this patent is extended or adjusted under 35 U.S.C. 154(b) by 1662 days.

(21) Appl. No.: 11/952,853

(22) Filed: Dec. 7, 2007

(65) Prior Publication Data

US 2009/0150023 A1 Jun. 11, 2009

(51) Int. Cl.
*G07C 5/00* (2006.01)

(52) U.S. Cl.
CPC ..... *G07C 5/008* (2013.01)

(58) Field of Classification Search
USPC ..... 701/29–33, 35, 115, 123, 29.1, 29.2, 701/31.4, 33.4; 340/989, 991–993; 455/99
See application file for complete search history.

(56) References Cited

U.S. PATENT DOCUMENTS

| | | | | |
|---|---|---|---|---|
| 6,879,894 | B1 * | 4/2005 | Lightner et al. | 701/33 |
| 2002/0133273 | A1 * | 9/2002 | Lowrey et al. | 701/29 |
| 2005/0256615 | A1 * | 11/2005 | Wang et al. | 701/1 |
| 2008/0126111 | A1 * | 5/2008 | Loda | 705/1 |

* cited by examiner

*Primary Examiner* — Spencer Patton
(74) *Attorney, Agent, or Firm* — Anthony Luke Simon

(57) ABSTRACT

A system and method that reports vehicle data to one or more third parties using an onboard telematics unit. The method includes the steps of selecting a type of data to be reported and identifying a third party to receive the selected type of data. The onboard telematics unit receives a portion of the data that is classified as the type of data to be received by the third party. The vehicle information is then associated with the received data to create a report. The report is then transmitted to the third party using the onboard telematics unit allowing the third party to analyze the report. Several reports for various types of data may be generated to be disseminated to various third parties.

17 Claims, 3 Drawing Sheets

METHOD AND SYSTEM FOR PROVIDING VEHICLE DATA TO THIRD PARTY AUTHORIZED RECIPIENTS

TECHNICAL FIELD

The present invention relates generally to the acquisition and use of vehicle data and, more particularly, to gathering such data from a vehicle and providing it to third party recipients such as governmental entities, car dealerships, service stations, for various purposes of relating to the use, performance and service of the vehicle.

BACKGROUND OF THE INVENTION

The computer systems on board motor vehicles are quite sophisticated. The onboard computers collect data from every aspect of the operation of the vehicle, from the pressure within the tires to the number of misfires that occurs in a particular cylinder of the internal combustion engine. All of this information is stored and may be downloaded when the vehicle is taken to an establishment that is authorized to access the information.

In addition, third party entities offer incentives to owners of vehicles based on the performance of the owner in operating the vehicle. For example, an insurance company may provide an incentive for the number of miles a vehicle travels without the owner thereof making a claim against his or her insurance policy. These incentives do not occur immediately as most owners of vehicles do not contact their insurance provider as soon as certain milestones are met.

Some governmental regulations currently require vehicle owners to have their vehicle emissions periodically checked by a certified testing facility to verify that they do not exceed predetermined limits. Oftentimes, the regulations required that the owners take their vehicles to certified facilities to collect vehicle emission data from the vehicle. The vehicle emissions data is typically collected in one of several different ways. According to one method, the vehicle emissions are measured by a device that is connected to the vehicles tailpipe while the vehicle is being driven on a dynamometer over a driving cycle that simulates typical city driving and includes periods of acceleration, cruise and deceleration. According to another method which is used primarily with newer vehicles, various electronic modules located throughout the vehicle collect vehicle emissions data while the vehicle is being driven. This data can then be transferred from an onboard diagnostic port (OBDII port) on the vehicle to a certified diagnostic machine that is designed to collect such information.

After the vehicle emissions test is complete, the vehicle owner is usually provided with test results in the form of a computer generated report. Some governmental regulations require that the vehicle owner then provide the test results to a designated governmental entity, like a Secretary of State or a Department of Motorized Vehicles, before they are able to register or renew their vehicle's license plates or tags.

As stated above, the vehicle collects numerous parameters and outputs regarding its performance and the use thereof constantly. This data would be much more useful to the owner of the vehicle if this data were able to be disseminated to the authorized recipients of the data in real time or periodically over the life of the vehicle, wherein the periods are shorter than the periods in which a vehicle is maintained or inspected.

SUMMARY OF THE INVENTION

In accordance with one aspect of the invention, there is provided a method of reporting vehicle data to a third party using an onboard telematics unit. The method includes the steps of selecting a type of data to be reported. A third party is identified to receive the type of data from the vehicle. The onboard telematics unit receives a portion of the data that is classified as the type of data to be received by the third party. The vehicle information is then associated with the received data to create a report. The report is then transmitted to the third party using the onboard telematics unit allowing the third party to analyze the report.

Another aspect of the invention includes a method for reporting vehicle data to a plurality of third parties using an onboard telematics unit. The method includes the steps of selecting a plurality of types of data to be reported. A plurality of third parties are identified to receive each of the plurality of types of data. The onboard telematics unit then receives portions of the data relating a subset of the plurality of the types of data to be received by a portion of the plurality of third parties. The vehicle information is then correlated to each of the portions of data to create a group of reports. Each of the group of reports is then transmitted to each of the portion of the plurality of third parties independently of each other.

In accordance with another aspect of the invention, there is provided a system for reporting vehicle data to a third party. The system includes a vehicle having an onboard telematics unit, and a call center accessible by the telematics unit using wireless data communication via wireless carrier system. The call center includes at least one computer configured to provide a website having at least one web page that enables configuration of third party data reporting by a vehicle owner. The web page enables the vehicle owner to identify one or more types of data to be reported, and to identify one or more third parties selected to receive vehicle data. In response to configuration of the third party data reporting by the vehicle owner, vehicle data is obtained by the telematics unit at the vehicle and is sent to the identified third party.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The method for providing vehicle data described below can be used to conveniently provide designated third party recipients such as automobile dealerships, governmental entities, insurance providers, or the like, with information pertaining to the performance and use of the vehicle. By wirelessly transmitting vehicle data from a vehicle to a call center and then providing that data from the call center to a third party recipient, the present method enables a vehicle owner to maximize the performance of the vehicle and optimize any incentive program available to the owner without having the bring the vehicle into a service center or the like.

Communications System—

Figure 1:
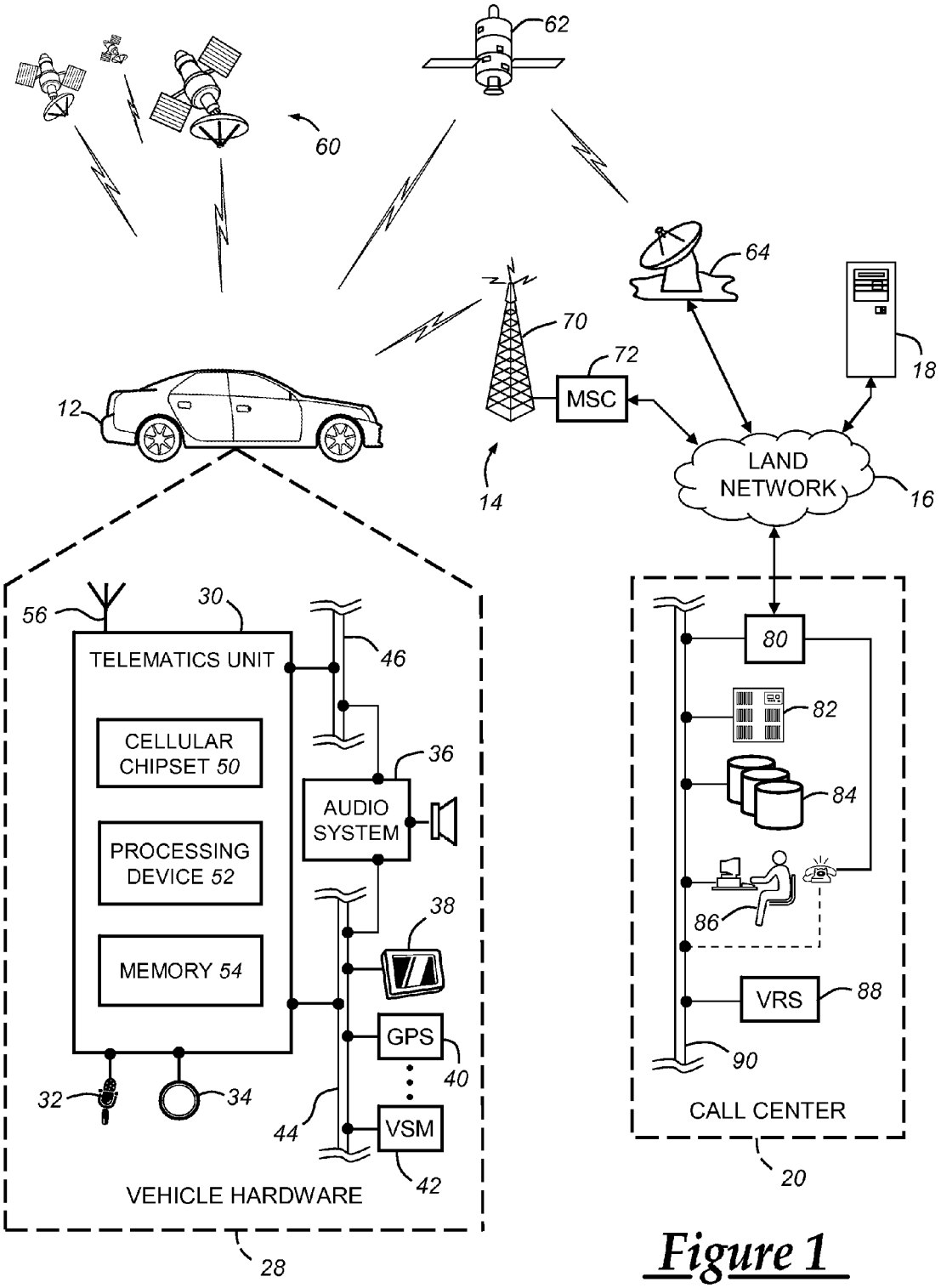
FIG. 1 is a block diagram showing an embodiment of a system capable of utilizing the method described below.

With reference to FIG. 1, there is shown an exemplary operating environment that comprises a mobile vehicle communications system 10 and that can be used to implement the method disclosed herein. Communications system 10 generally includes a vehicle 12, one or more wireless carrier systems 14, a land communications network 16, a computer 18, and a call center 20. It should be understood that the disclosed method can be used with any number of different systems and is not specifically limited to the operating environment shown here. Also, the architecture, construction, setup, and operation of the system 10 and its individual components are generally known in the art. Thus, the following paragraphs simply provide a brief overview of one such exemplary system 10; however, other systems not shown here could employ the disclosed method as well.

Vehicle 12 is depicted in the illustrated embodiment as a passenger car, but it should be appreciated that any other vehicle including motorcycles, trucks, sports utility vehicles (SUVs), recreational vehicles (RVs), marine vessels, aircraft, etc., can also be used. Some of the vehicle electronics 28 is shown generally in FIG. 1 and includes a telematics unit 30, a microphone 32, one or more pushbuttons or other control inputs 34, an audio system 36, a visual display 38, and a GPS module 40 as well as a number of vehicle system modules (VSMs) 42. Some of these devices can be connected directly to the telematics unit such as, for example, the microphone 32 and pushbutton(s) 34, whereas others are indirectly connected using one or more network connections, such as a communications bus 44 or an entertainment bus 46. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

Telematics unit 30 is an OEM-installed device that enables wireless voice and/or data communication over wireless carrier system 14 and via wireless networking so that the vehicle can communicate with call center 20, other telematics-enabled vehicles, or some other entity or device. The telematics unit preferably uses radio transmissions to establish a communications channel (a voice channel and/or a data channel) with wireless carrier system 14 so that voice and/or data transmissions can be sent and received over the channel. By providing both voice and data communication, telematics unit 30 enables the vehicle to offer a number of different services including those related to navigation, telephony, emergency assistance, diagnostics, infotainment, etc. Data can be sent either via a data connection, such as via packet data transmission over a data channel, or via a voice channel using techniques known in the art. For combined services that involve both voice communication (e.g., with a live advisor or voice response unit at the call center 20) and data communication (e.g., to provide GPS location data or vehicle diagnostic data to the call center 20), the system can utilize a single call over a voice channel and switch as needed between voice and data transmission over the voice channel, and this can be done using techniques known to those skilled in the art.

According to one embodiment, telematics unit 30 utilizes cellular communication according to either GSM or CDMA standards and thus includes a standard cellular chipset 50 for voice communications like hands-free calling, a wireless modem for data transmission, an electronic processing device 52, one or more digital memory devices 54, and a dual antenna 56. It should be appreciated that the modem can either be implemented through software that is stored in the telematics unit and is executed by processor 52, or it can be a separate hardware component located internal or external to telematics unit 30. The modem can operate using any number of different standards or protocols such as EVDO, CDMA, GPRS, and EDGE. Wireless networking between the vehicle and other networked devices can also be carried out using telematics unit 30. For this purpose, telematics unit 30 can be configured to communicate wireless according to one or more wireless protocols, such as any of the IEEE 802.11 protocols, WiMAX, or Bluetooth. When used for packet-switch data communication such as TCP/IP, the telematics unit can be configured with a static IP address or can set up to automatically receive an assigned IP address from another device on the network such as a router or from a network address server.

Processor 52 can be any type of device capable of processing electronic instructions including microprocessors, microcontrollers, host processors, controllers, vehicle communication processors, and application specific integrated circuits (ASICs). It can be a dedicated processor used only for telematics unit 30 or can be shared with other vehicle systems. Processor 52 executes various types of digitally-stored instructions, such as software or firmware programs stored in memory 54, which enable the telematics unit to provide a wide variety of services. For instance, processor 52 can execute programs or process data to carry out at least a part of the method discussed herein.

Telematics unit 30 can be used to provide a diverse range of vehicle services that involve wireless communication to and/or from the vehicle. Such services include: turn-by-turn directions and other navigation-related services that are provided in conjunction with the GPS-based vehicle navigation module 40; airbag deployment notification and other emergency or roadside assistance-related services that are provided in connection with one or more collision sensor interface modules such as a body control module (not shown); diagnostic reporting using one or more diagnostic modules; and infotainment-related services where music, webpages, movies, television programs, videogames and/or other information is downloaded by an infotainment module (not shown) and is stored for current or later playback. The above-listed services are by no means an exhaustive list of all of the capabilities of telematics unit 30, but are simply an enumeration of some of the services that the telematics unit is capable of offering. Furthermore, it should be understood that at least some of the aforementioned modules could be implemented in the form of software instructions saved internal or external to telematics unit 30, they could be hardware components located internal or external to telematics unit 30, or they could be integrated and/or shared with each other or with other systems located throughout the vehicle, to cite but a few possibilities. In the event that the modules are implemented as VSMs 42 located external to telematics unit 30, they could utilize vehicle bus 44 to exchange data and commands with the telematics unit.

GPS module 40 receives radio signals from a constellation 60 of GPS satellites. From these signals, the module 40 can determine vehicle position that is used for providing navigation and other position-related services to the vehicle driver. Navigation information can be presented on the display 38 (or other display within the vehicle) or can be presented verbally such as is done when supplying turn-by-turn navigation. The navigation services can be provided using a dedicated in-vehicle navigation module (which can be part of GPS module 40), or some or all navigation services can be done via telematics unit 30, wherein the position information is sent to a remote location for purposes of providing the vehicle with navigation maps, map annotations (points of interest, restaurants, etc.), route calculations, and the like. The position information can be supplied to call center 20 or other remote computer system, such as computer 18, for other purposes, such as fleet management. Also, new or updated map data can be downloaded to the GPS module 40 from the call center 20 via the telematics unit 30.

Apart from the audio system 36 and GPS module 40, the vehicle 12 can include other vehicle system modules (VSMs) 42 in the form of electronic hardware components that are located throughout the vehicle and typically receive input from one or more sensors and use the sensed input to perform diagnostic, monitoring, control, reporting and/or other functions. Each of the VSMs 42 is preferably connected by communications bus 44 to the other VSMs, as well as to the telematics unit 30, and can be programmed to run vehicle system and subsystem diagnostic tests. As examples, one VSM 42 can be an engine control module (ECM) that controls various aspects of engine operation such as fuel ignition and ignition timing, another VSM 42 can be a powertrain control module that regulates operation of one or more components of the vehicle powertrain, and another VSM 42 can be a body control module that governs various electrical components located throughout the vehicle, like the vehicle's power door locks and headlights. According to one embodiment, the engine control module is equipped with on-board diagnostic (OBD) features that provide myriad real-time data, such as that received from various sensors including vehicle emissions sensors, and provide a standardized series of diagnostic trouble codes (DTCs) that allow a technician to rapidly identify and remedy malfunctions within the vehicle. As is appreciated by those skilled in the art, the above-mentioned VSMs are only examples of some of the modules that may be used in vehicle 12, as numerous others are also possible.

Vehicle electronics 28 also includes a number of vehicle user interfaces that provide vehicle occupants with a means of providing and/or receiving information, including microphone 32, pushbuttons(s) 34, audio system 36, and visual display 38. As used herein, the term 'vehicle user interface' broadly includes any suitable form of electronic device, including both hardware and software components, which is located on the vehicle and enables a vehicle user to communicate with or through a component of the vehicle. Microphone 32 provides audio input to the telematics unit to enable the driver or other occupant to provide voice commands and carry out hands-free calling via the wireless carrier system 14. For this purpose, it can be connected to an on-board automated voice processing unit utilizing human-machine interface (HMI) technology known in the art. The pushbutton(s) 34 allow manual user input into the telematics unit 30 to initiate wireless telephone calls and provide other data, response, or control input. Separate pushbuttons can be used for initiating emergency calls versus regular service assistance calls to the call center 20. Audio system 36 provides audio output to a vehicle occupant and can be a dedicated, stand-alone system or part of the primary vehicle audio system. According to the particular embodiment shown here, audio system 36 is operatively coupled to both vehicle bus 44 and entertainment bus 46 and can provide AM, FM and satellite radio, CD, DVD and other multimedia functionality. This functionality can be provided in conjunction with or independent of the infotainment module described above. Visual display 38 is preferably a graphics display, such as a touch screen on the instrument panel or a heads-up display reflected off of the windshield, and can be used to provide a multitude of input and output functions. Various other vehicle user interfaces can also be utilized, as the interfaces of FIG. 1 are only an example of one particular implementation.

Wireless carrier system 14 is preferably a cellular telephone system that includes a plurality of cell towers 70 (only one shown), one or more mobile switching centers (MSCs) 72, as well as any other networking components required to connect wireless carrier system 14 with land network 16. Each cell tower 70 includes sending and receiving antennas and a base station, with the base stations from different cell towers being connected to the MSC 72 either directly or via intermediary equipment such as a base station controller. Cellular system 14 can implement any suitable communications technology, including for example, analog technologies such as AMPS, or the newer digital technologies such as CDMA (e.g., CDMA2000) or GSM/GPRS. As will be appreciated by those skilled in the art, various cell tower/base station/MSC arrangements are possible and could be used with wireless system 14. For instance, the base station and cell tower could be co-located at the same site or they could be remotely located from one another, each base station could be responsible for a single cell tower or a single base station could service various cell towers, and various base stations could be coupled to a single MSC, to name but a few of the possible arrangements.

Apart from using wireless carrier system 14, a different wireless carrier system in the form of satellite communication can be used to provide uni-directional or bi-directional communication with the vehicle. This can be done using one or more communication satellites 62 and an uplink transmitting station 64. Uni-directional communication can be, for example, satellite radio services, wherein programming content (news, music, etc.) is received by transmitting station 64, packaged for upload, and then sent to the satellite 62, which broadcasts the programming to subscribers. Bi-directional communication can be, for example, satellite telephony services using satellite 62 to relay telephone communications between the vehicle 12 and station 64. If used, this satellite telephony can be utilized either in addition to or in lieu of wireless carrier system 14.

Land network 16 may be a conventional land-based telecommunications network that is connected to one or more landline telephones and connects wireless carrier system 14 to call center 20. For example, land network 16 may include a public switched telephone network (PSTN) such as that used to provide hardwired telephony, packet-switched data communications, and the Internet infrastructure. One or more segments of land network 16 could be implemented through the use of a standard wired network, a fiber or other optical network, a cable network, power lines, other wireless networks such as wireless local area networks (WLANs), or networks providing broadband wireless access (BWA), or any combination thereof. Furthermore, call center 20 need not be connected via land network 16, but could include wireless telephony equipment so that it can communicate directly with a wireless network, such as wireless carrier system 14.

Computer 18 can be one of a number of computers accessible via a private or public network such as the Internet. Each such computer 18 can be used for one or more purposes, such as a web server accessible by the vehicle via telematics unit 30 and wireless carrier 14. Other such accessible computers 18 can be, for example: a service center computer where diagnostic information and other vehicle data can be uploaded from the vehicle via the telematics unit 30; a client computer used by the vehicle owner or other subscriber for such purposes as accessing or receiving vehicle data or to setting up or configuring subscriber preferences or controlling vehicle functions; or a third party repository to or from which vehicle data or other information is provided, whether by communicating with the vehicle 12 or call center 20, or both. A computer 18 can also be used for providing Internet connectivity such as DNS services or as a network address server that uses DHCP or other suitable protocol to assign an IP address to the vehicle 12.

Call center 20 is designed to provide the vehicle electronics 28 with a number of different system back-end functions and, according to the exemplary embodiment shown here, generally includes one or more switches 80, servers 82, databases 84, live advisors 86, as well as an automated voice response system (VRS) 88, all of which are known in the art. These various call center components are preferably coupled to one another via a wired or wireless local area network 90. Switch 80, which can be a private branch exchange (PBX) switch, routes incoming signals so that voice transmissions are usually sent to either the live adviser 86 by regular phone or to the automated voice response system 88 using VoIP. The live advisor phone can also use VoIP as indicated by the broken line in FIG. 1. VoIP and other data communication through the switch 80 is implemented via a modem (not shown) connected between the switch 80 and network 90. Data transmissions are passed via the modem to server 82 and/or database 84. Database 84 can store account information such as subscriber authentication information, vehicle identifiers, profile records, behavioral patterns, and other pertinent subscriber information. Data transmissions may also be conducted by wireless systems, such as 802.11x, GPRS, and the like. Although the illustrated embodiment has been described as it would be used in conjunction with a manned call center 20 using live advisor 86, it will be appreciated that the call center can instead utilize VRS 88 as an automated advisor or, a combination of VRS 88 and the live advisor 86 can be used.

Method for Providing Vehicle Data—

Figure 2:
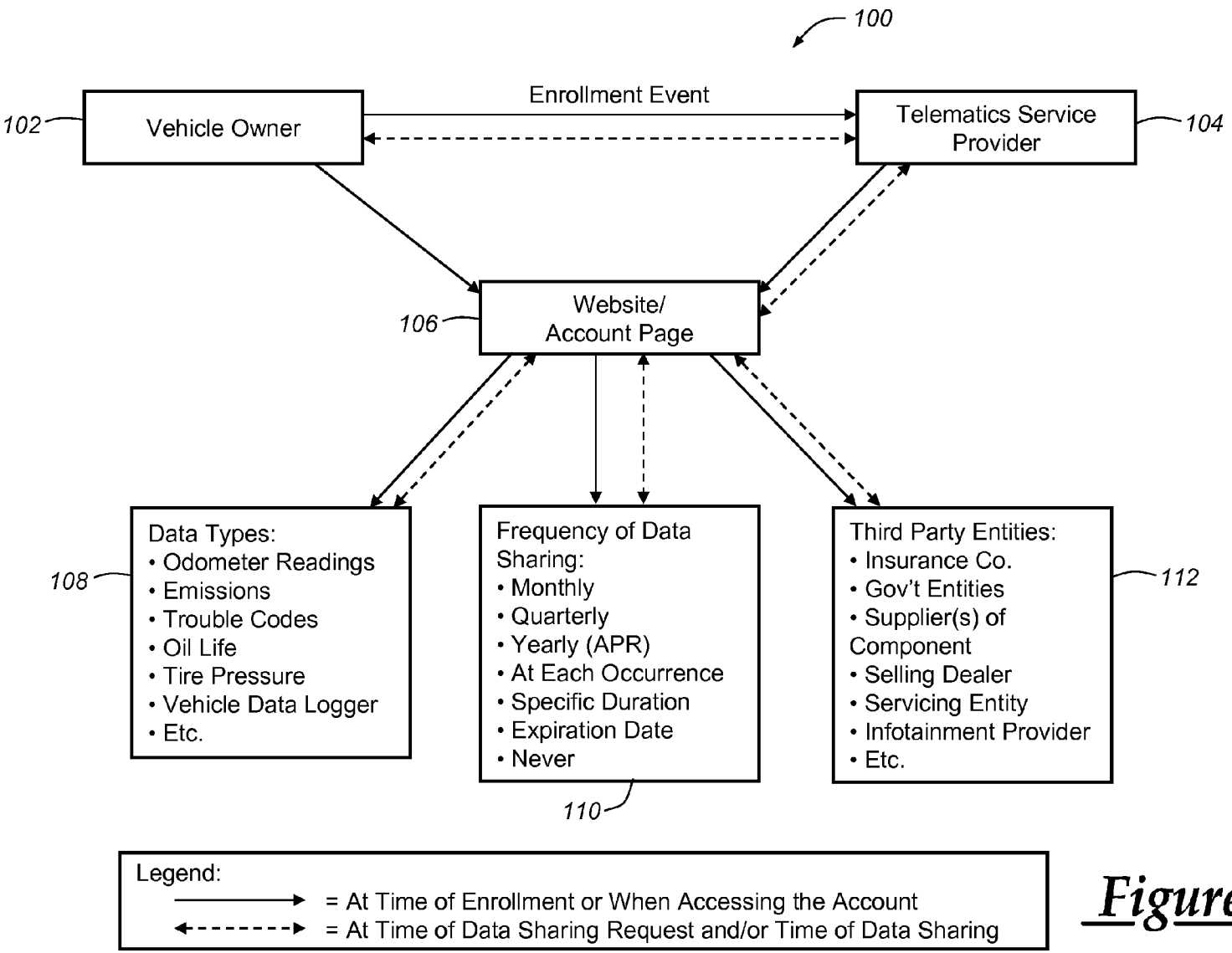
FIG. 2 is a data flow diagram illustrating how data may flow at the time of enrollment and at data sharing events.

Referring to FIG. 2, a diagram illustrating the flow of data between the vehicle owner, the telematics service provider, and third party recipients, is shown at 100. The vehicle owner 102 (i.e., actual owner, a lessee, or other authorized subscriber) may transmit configuration information through an enrollment event or process as indicated by the solid arrows. Information is transmitted to the telematics service provider 104 either directly from the vehicle owner vehicle 12, via its telematics unit 30, or it may access the telematics service provider via an online account, represented by an access-restricted account page on a website 106. This website can be hosted on the computer 18 or at the call center 20. Using the Internet to connect to this website 106, data types 108, definitions of events 110, and third party entities 112 are identified and/or selected by the vehicle owner 102. Once the owner is enrolled, communication and data are shared bidirectionally between each of these sources of information, as is indicated by the dashed arrows in FIG. 2.

When configured via account page 106, access is preferably gained via a password-protected login that limits access to the vehicle owner 102. The account page can include checkboxes associated with each of the different types of data which enables the owner 102 to opt-in or opt-out of a particular third party data reporting. This could allow the owner to specify that emissions information be provided to the appropriate governmental vehicle licensing agency (e.g., the department of motorized vehicles), but to opt-out of providing mileage information to their insurance agency. Upon selection of a particular data type (e.g., emissions data), the owner can then be given the ability to identify the third party (ies) to which that information is to be sent, and the conditions under which it is sent (e.g., how often). Optionally, the third party information can be automatically set based on prior stored information associated with the vehicle owner or the vehicle. For example, where the owner selects diagnostic information such as DTCs to be sent to third parties, the system can automatically identify the dealership from which the vehicle was purchased as the intended third party recipient, and this information can be obtained from a customer delivery record or the like.

The data types 108 that a vehicle owner 102 may want to share with third party entities 112 may include odometer readings, emissions output, trouble codes, oil life, tire pressure, vehicle data logger, or the like. The frequency on which data is shared between the vehicle 12 and the third party entities 112 may be set by the vehicle owner 102 in a manner which seems appropriate to the vehicle owner 102. Examples of the frequency in which a data sharing event would occur include monthly, quarterly, annually, at an occurrence of an event (a trigger), after a specific amount of time at an expiration date of a subscription, or the like. If a vehicle owner 102 does not wish to share data with a third party entity, that data may be never transmitted to the third party entities 112. Types of third party entities 112 that may benefit the vehicle owner 102 by having the data of the vehicle 12 prior to visits to service stations and the like include insurance companies, government entities, suppliers of components, dealerships, servicing entities, infotainment providers, or the like. Data may be transmitted to the vehicle owner 102 through vehicle diagnostic emails, through the website login that the vehicle owner 102 may utilize, or directly through the telematics unit 30 in the vehicle 12.

Figure 3:
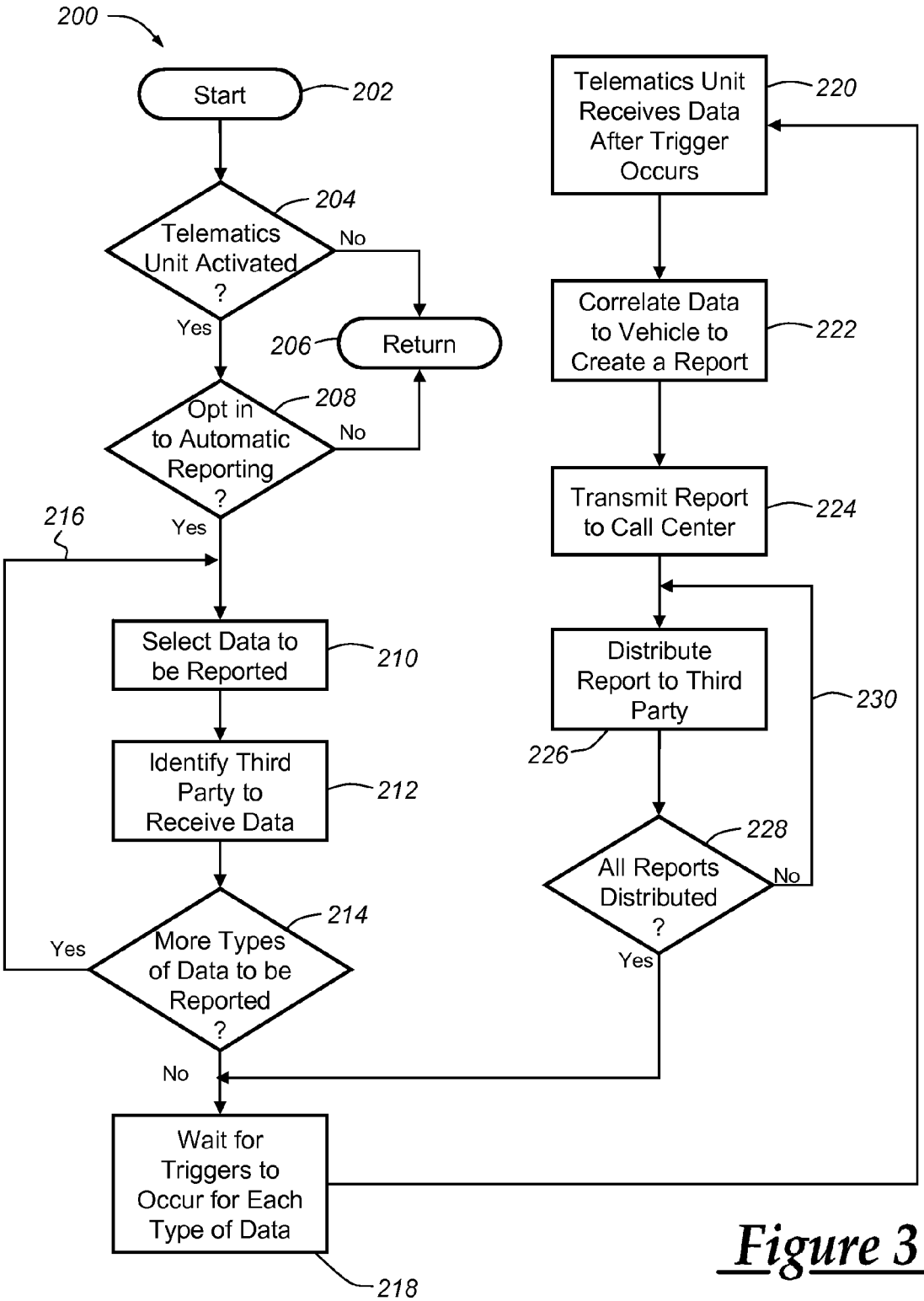
FIG. 3 is a flow chart showing the steps of an embodiment of a method for providing vehicle data to third party recipients.

Turning now to FIG. 3, there is shown a flow chart demonstrating an embodiment of a method 200 that provides vehicle data to third party entities 112. In general, the method 200 receives vehicle data requests, retrieves vehicle data from at least one vehicle system module VSM 42, uses vehicle hardware 28 to wirelessly transmit the vehicle data to the call center 20, and then makes the data available to one of a plurality of third party entities 112, such as insurance companies, government entities, dealerships or the like, in order to accurately identify a performance and use of the vehicle 12 without having the vehicle 12 be brought to a service center. "Vehicle data" broadly includes any information that is representative of, or in some way pertains to, the performance of the vehicle 12, the use of the vehicle 12, the mileage that the vehicle 12 travels, DTCs, diagnostic execution test records, sensor readings, vehicle location (e.g., GPS data), infotainment usage, etc. It should be appreciated by those skilled in the art that many other types of data collected by the vehicle 12 may be incorporated into the method 200.

The method begins at 202. It is first determined whether the telematics unit 30 is activated at 204. If not, the method 200 is terminated and returns at 206. If the telematics unit 30 is activated, it is determined whether the vehicle owner or subscriber 102 has opted into the reporting of vehicle data at 208. If not, the method then returns at 206 and is terminated. If the vehicle owner 102 has opted for automatic reporting according to the present method 200, the vehicle owner 102 selects the data to be reported at 210. The vehicle owner 102 then identifies the third party entities 112 that will receive that particular data at 212. It is then determined whether there are more types of data to be reported at 214. While it is contemplated that each type of data to be reported would be sent to a single third party entity 112, it is appreciated that one type of data may be sent to a plurality of third party entities 112. If so, the method loops back at 216 where the same data to be reported is selected at 210 and another third party entity is identified at 212 to receive the data.

The method 200 also uses loop 216 when the vehicle owner 102 chooses to select different types of data 108 at 210 to be sent to different third party entities 112 at 212. In this manner, the present method 200 allows a vehicle owner 102 to send several different types of data to several different types of third party entities 112. By way of example, a third party entity 112 such as an insurance company may receive odometer readings. A service entity is a third party entity 112 that may receive oil life data or tire pressure data, whereas a government entity may be a third party entity 112 that receives emissions outputs as data types.

If the vehicle owner 102 is finished matching data types with third party entities, the method 200 then waits for a trigger to occur for each type of data at 218. A trigger may be simply a frequency of data sharing 110 (FIG. 2), or it may be a specific event that occurs. By way of example, an event that occurs in a non-periodic fashion is the misfire of a cylinder of the internal combustion engine of the vehicle 12. If the same cylinder misfires at a frequency which is determined to be a malfunction, a trigger may occur to identify a service entity, as a third party entity 112 that the internal combustion engine needs to be serviced. Likewise, the trigger may be a periodic measurement, e.g., measuring the odometer for the life cycle of the oil. In this regard, the trigger can be a specific trigger sent to the vehicle via its telematics unit 30 for the purpose of generating the third party report at the appropriate time, or could be an existing trigger or one used for other purposes such a periodic diagnostic reporting.

Once a trigger has occurred, the data associated with the trigger is sent to the telematics unit at 220. Data relating to the event is associated with the vehicle information at 222 by combining it or aggregating it with the vehicle information. The vehicle information can include information used to uniquely identify the vehicle and may include a subscription number and/or a vehicle identification number. In some instances, such as for fleets of vehicles, the information may only generally identify the vehicle, such as by make and model or engine. The association of the data which was obtained at the occurrence of a trigger in combination with the vehicle information constitutes a rep ort. If authorization for automatic delivery is not given a request to authorize the transmission of the report is produced. Once authorized, the telematics unit 30 then transmits the report to the call center 20 at 224. The call center 20 is the telematics service provider 104 of FIG. 2. The call center 20 then distributes the report to the appropriate third party entity 112 at 226. It is then determined whether all the reports have been distributed by the telematics unit 30 at 228. If not, the method returns to step 226 through a loop 230 and distributes another report. If so, the method returns to step 218 and waits for another trigger to occur at 206.

The transmission of the report to the call center at step 224 by the telematics unit 30 includes the telematics unit 30 initiating a cellular call from wherever the vehicle 12 is located to the call center 20. This transmission of the report occurs either at the expiration of a predetermined time or after the occurrence of a predefined event such as a trigger. In another embodiment, this step 224 can be eliminated with the telematics unit 30 being configured to transmit the report to the third party without going through the call center (e.g., direct transmission from the vehicle to the third party). This can be an option where, for example, the owner 102 does not want the data shared with the call center 20. For this embodiment, the third party contact information can be provided in advance to the telematics unit, for example, during setup of the trigger used to initiate data collection and generation of the report.

At anytime during the ownership of the vehicle 12, the vehicle owner 102 may change or replace a third party entity 112 with another should the vehicle owner 102 desire. The vehicle owner 102 could change the third party entity 112 either through the account page 106 that allows the vehicle owner 102 to access the Internet system supporting the method 200 or it may contact the call center 20 using the onboard telematics unit 30.

The vehicle 12 will be collecting a plurality of types of data. At any given point, one type of data may be appropriate to send to one third party entity and the other may not have matured to a reporting status. Therefore, the onboard telematics unit 30 will only generate a report for that specific type of data that has matured and send it to the corresponding third party entity 112 once a report has been generated by the onboard telematics unit 30. It may be appreciated by one skilled in the art that there may be any number of combinations of reports being generated nearly simultaneously or in succession and transmitted to the appropriate third party entity 112 associated with that specific type of data. The method need not send every type of data to every third party entity 112 as such transmissions of data may be over burdensome and, in some instances, inappropriate.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A method for reporting vehicle data to a third party using an onboard telematics unit, the method comprising the steps of:

requesting from a vehicle owner the identity of one or more third parties other than the vehicle owner that are authorized to receive data from the vehicle;

receiving from the vehicle owner the identity of one or more authorized third parties other than the vehicle owner;

requesting the vehicle owner select one or more data types that correspond to each identified third party;

receiving from the vehicle owner at least one data type selection that corresponds to each identified third party;

receiving at the onboard telematics unit the data corresponding to the received data type(s);

creating a report that includes vehicle information and the received data that is authorized by the vehicle owner to be sent to each third party; and transmitting the report from the onboard telematics unit directly to each identified third party in response to one or more triggers automatically initiated by at least some portion of vehicle electronics, wherein the identity of the one or more authorized third parties is determined based on the trigger.

2. A method as set forth in claim 1, including the step of receiving authorization to transmit the report prior to the step of transmitting the report.

3. A method as set forth in claim 1, including the step of establishing a transmission of the report to occur after an expiration of a predetermined time period.

4. A method as set forth in claim 1, including the step of setting a transmission of the report to occur after an occurrence of a predefined event.

5. A method as set forth in claim 1, including the step of subsequently changing each identified third party to another recipient.

6. A method as set forth in claim 1, wherein the identity of one or more third parties that are authorized to receive data from the vehicle and the data type that corresponds to each identified third party are received via an access-restricted web page.

7. A method for reporting vehicle data to a plurality of third parties using an onboard telematics unit, the method comprising the steps of:

enrolling a user in a telematics subscriber service;

requesting from the user the identity of one or more third parties other than the vehicle owner that are authorized to receive data from the vehicle as part of enrolling the user in the telematics subscriber service;

receiving from the user the identity of one or more authorized third parties other than the vehicle owner;

requesting the user select one or more data types that correspond to each identified third party;

receiving from the user at least one data type selection that corresponds to each identified third party;

receiving at the onboard telematics unit the data type(s) that correspond to each identified third party;

detecting a trigger automatically initiated by at least some portion of vehicle electronics using the onboard telematics unit;

associating the trigger at the vehicle with one of the identified third parties;

creating a report using vehicle information and the received data type(s) corresponding to the identified third party associated with the trigger; and transmitting the report to the identified third party associated with the trigger.

8. A method as set forth in claim 7, including the step of transmitting the report to a call center.

9. A method as set forth in claim 7, including the step of distributing a plurality of reports from the call center to more than one identified third party, wherein each of the plurality of reports includes different data types.

10. A method as set forth in claim 9, wherein the step of transmitting includes the step of placing a cellular call by the onboard telematics unit to the call center.

11. A method as set forth in claim 10, including the step of receiving authorization to transmit the report prior to the step of transmitting.

12. A method as set forth in claim 10, including the step of establishing a predetermined time period after which the report will be transmitted.

13. A method as set forth in claim 10, including the step of establishing a predefined event, the occurrence of which causes the transmission of each report to each identified third party.

14. A method as set forth in claim 7, wherein the identity of one or more authorized third parties and the data type selection that corresponds to each identified third party are received via an access-restricted web page.

15. A system for reporting vehicle data to a third party, comprising:

a vehicle having an onboard telematics unit; and a call center accessible by the telematics unit using wireless data communication via wireless carrier system, said call center including at least one computer configured to provide a website having at least one web page that enables configuration of third party data reporting by a vehicle owner, the web page enabling the vehicle owner to identify one or more types of data to be reported, and to identify one or more third parties other than the vehicle owner selected to receive vehicle data; wherein, in response to configuration of the third party data reporting by the vehicle owner, the on-board telematics unit monitors for a trigger that is automatically initiated by at least some portion of vehicle electronics and associated with one of the identified third parties, and upon detecting the trigger, vehicle data obtained by the telematics unit at the vehicle is sent to the identified third party associated with the detected trigger.

16. A system as defined in claim 15, wherein the call center receives the vehicle data and sends it to the third party along with vehicle information that uniquely identifies the vehicle.

17. A system as defined in claim 15, wherein, in response to configuration of the third party data reporting via the web site, the call center generates a trigger that is sent to the vehicle telematics unit, and wherein, in response to occurrence of the trigger, the vehicle telematics unit obtains the vehicle data and sends it to the call center for transmission to the third party.

* * * * *